US005821868A

United States Patent [19]

Kühling

[11] Patent Number: 5,821,868

[45] Date of Patent: Oct. 13, 1998

[54] MONITORING DEVICE FOR COMPUTERS WITH CONNECTED PERIPHERALS SUCH AS MONITORS, PRINTERS OR THE LIKE

[76] Inventor: Bernd Kühling, Falkensteinstr. 180, D-46047 Oberhausen, Germany

[21] Appl. No.: 809,273

[22] PCT Filed: Aug. 16, 1995

[86] PCT No.: PCT/EP95/03225

§ 371 Date: May 19, 1997

§ 102(e) Date: May 19, 1997

[87] PCT Pub. No.: WO96/08800

PCT Pub. Date: Mar. 21, 1996

[30] Foreign Application Priority Data

Sep. 14, 1994 [DE] Germany ..... 44 32 676.9

[51] Int. Cl.[6] ..... G08B 21/00

[52] U.S. Cl. ..... 340/649; 340/568; 340/571; 340/652

[58] Field of Search ..... 340/568, 571, 340/687, 650, 649, 686, 529, 664, 652

[56] References Cited

U.S. PATENT DOCUMENTS

| | | | |
|---|---|---|---|
| 3,423,747 | 1/1969 | Hogencamp | 340/650 |
| 4,237,450 | 12/1980 | Canez | 340/571 |
| 4,327,360 | 4/1982 | Brown | 340/650 |
| 5,003,292 | 3/1991 | Harding et al. | 340/568 |
| 5,034,723 | 7/1991 | Maman | 340/568 |
| 5,059,948 | 10/1991 | Desmeules | 340/568 |
| 5,142,269 | 8/1992 | Mueller | 340/568 |
| 5,159,316 | 10/1992 | Lazzara | 340/568 |
| 5,231,375 | 7/1993 | Sanders et al. | 340/529 |
| 5,675,321 | 10/1997 | McBride | 340/571 |

FOREIGN PATENT DOCUMENTS

| | | |
|---|---|---|
| 2593950 | 8/1987 | France . |
| 9110174 | 12/1991 | Germany . |
| 9311034 | 11/1993 | Germany . |

OTHER PUBLICATIONS

The New England Journal of Medecine, 303, No. 10, 583 (Jul. 3, 1980).

*Primary Examiner*—Jeffery A. Hofsass
*Assistant Examiner*—Anh La
*Attorney, Agent, or Firm*—Anderson, Kill & Olick, P.C.

[57] ABSTRACT

The present invention relates to a monitoring device for computers with connected peripherals such as monitors, printers or the like, wherein all peripherals are respectively connected with the computer by at least one ground line. At that, each ground line includes a sensor device looped in between the peripheral and the computer for monitoring a continuous ground connection, and an alarm device actuated by the sensor device, when a deviation is recorded, for signaling an interrupted ground connection. Thereby, a simple and operationally reliable monitoring of one or more computers with connected peripherals is achieved.

8 Claims, 3 Drawing Sheets

Figure 1:
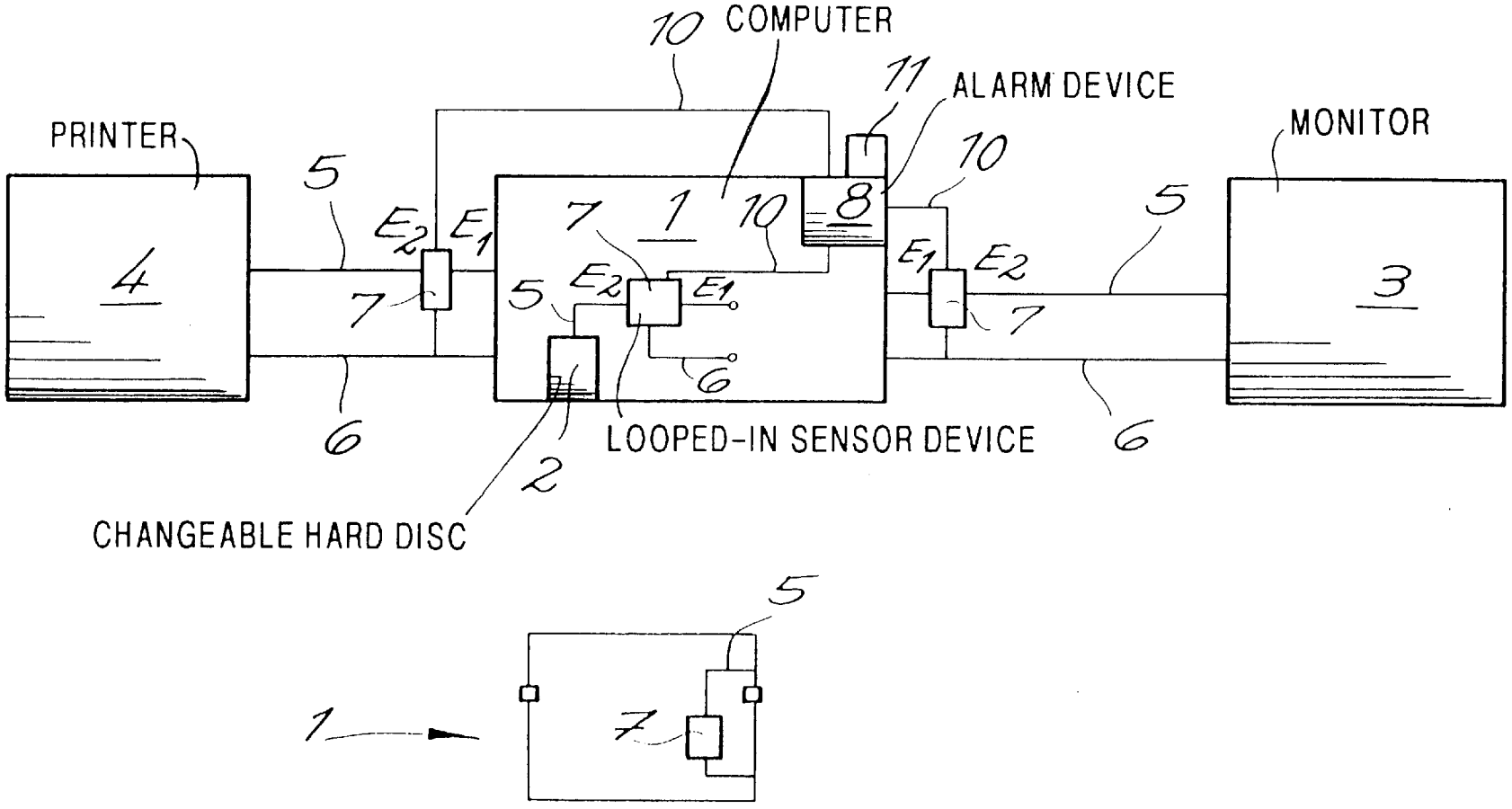

MONITORING DEVICE FOR COMPUTERS WITH CONNECTED PERIPHERALS SUCH AS MONITORS, PRINTERS OR THE LIKE

The invention relates to a monitoring device for computers with connected peripherals such as monitors, printers and the like, wherein all peripherals are connected with the computer by at least one ground line.

One such monitoring device is disclosed in DE-GM 91 10 174. In this monitoring device, which is called an anti-theft device, there are provided a light signal emitted transmitter and a receiver associated with the light signal transmitter for receiving the light signals emitting by the transmitter. In addition, a light waveguide, which connects the transmitter and the receiver and is formed as a locking element, is provided. The light waveguide is formed of several parts releasably connected with each other with couplings and counter couplings. In this way, a plurality of apparatuses such as computers with connected monitors, printers and the like can be connected with each other with a light waveguide formed as a locking element, i.e., they become interlinked and, thus, protected against theft. Thus, as soon the multi-part light waveguide is interrupted by an unauthorized release of a coupling from its counterpart or is manipulated in a similar way, no signal or a changed light signal is transmitted from the transmitter to the receiver. A computer anti-theft device with a sensor unit, which includes a computer side and stationary sensor devices operationally electrically connected with each other, is disclosed in DE-GM 93 11034. The stationary sensor device is advantageously formed as conduit having, on one side, a contact point and, on the other side, a loop wound around a stationary part, e.g., a desk leg or a shelf rail. The severing of the conductor, loosening of the plug connection or the like generate an alarm signal.

The known devices are adapted more or less only to monitoring computers, while the conventionally connected peripherals such as monitors, printers or the like are not monitored and can be sealed (please see DE GM 93 11 034). On the other side, the known conventional monitoring devices formed as multi-part light waveguide locking elements are very-expensive. Here lies the invention.

U.S. Pat. No. 3,423,747 discloses a monitoring device for, e.g., a TV-set in which each ground line between a respective peripheral and, e.g., the TV-set has a looped-in common sensor device for monitoring the continuous ground connection. The sensor device is set for recording deviations of an electrical potential from a ground potential at a respective looped-in end of the sensor device. There is provided an alarm device, which is actuated by a sensor device upon recording of a deviation, for signaling ground connection interruption.

The subject of the invention is a monitoring device of the type described in the beginning which is simple and operationally reliable.

This object is achieved by a monitoring device having features of claim 1.

These features of the invention insure a simple and operationally reliable construction of the monitoring device because the invention is based on already available connections between the computer and usually connected therewith peripherals-such as monitors, printers and the like. Each such connection necessarily includes a ground line. The invention recognized that a computer with a connected peripheral can be monitored by monitoring the ground connection between the computer and the peripheral. This is effected with a sensor device looped in between the computer and the peripheral for monitoring a continuous ground connection therebetween. In this way, monitoring can be effected without any interference with the peripheral and without disturbing its function. Simultaneously, the monitoring device can be used even with any type of a peripheral and a computer. Overall, neither the operation of the computer nor that of a peripheral is disturbed because the measured ground connection does not have any active potential and, consequently, no disturbance in the data flow between the peripherals or between the computer and the peripherals occurs. The sensor device is set for recording, i.e., for measuring and/or storing (staging) of the deviations of the operation of the computer nor that of a peripheral is disturbed because the measured ground connection does not have any active potential and, consequently, no disturbance in the data flow between the peripherals or between the computer and the peripherals occurs. The sensor device is set for recording, i.e., for measuring and/or storing (staging) of the deviations of the electrical potential from a ground potential at a respective looped-in end of the sensor device. In this way, a successful monitoring can take place even if the connection between the sensor device and the alarm device is disturbed. In any case, a reliable monitoring of one or several computers with respective connected peripherals in a simple and operationally reliable manner becomes possible.

The further important features of the invention will be discussed bellow. Advantageously, the sensor device is formed as a plug-in coupler provided between the computer and a respective peripheral, e.g., as a plug adapter pin up on an associated output of the computer. Here, the invention is based on a knowledge that the monitored computer is generally connected with the connectable peripheral by a standard cable, so that respective endside and peripheral side standard plug and socket with a standard number of poles (e.g. 9-, 15-, 25-, etc. poles) are used for a series or parallel data transmission. In any case, there exists a possibility to form the sensor device as a plug adaptor between the computer and the connecting cable for the connectable peripheral. The sensor device is advantageously provided at a respective looped-in end with a computer side input and a peripheral side input, and is set to record deviations of the ground potential at one input or both inputs. Additionally, there is provided at least one other ground connection, which serves as a reference potential, and an operational voltage connection for feeding the sensor device with current. There is also provided an output connection leading to the alarm device for signaling an interrupted ground connection. In case the sensor device is formed as a plug adaptor, the output connection to the alarm device is formed as a cable leading from the plug adaptor. This multiwire cable can also be used for feeding current to the sensor device via the alarm device. It is also possible to establish a computer side operational voltage connection and a ground connection with a connection socket or plug provided on the computer and a plug adaptor. Independently of this, for providing a network-independent power supply, an accumulator, which is buffered during the operation of the computer, can be provided. This accumulator, naturally a plurality of accumulators can be provided, can be arranged e.g., together with the alarm device in the same housing. In this case, the power supply of the sensor device is effected from that housing. Such a network-independent power supply proved to be advantageous when monitoring of a computer with connected peripherals is necessary also with a pulled-out main plug.

Preferably, the sensor device for monitoring a continuous ground connection comprises an analog idle current loop monitor or a digital signal shape monitor of a square wave signal which is communicated to an additional signal input of the sensor device and phases of which are shifted, in particular, which is negated at a continuous ground connection. The use of a digital signal shape monitor of a (negated) square wave signal enables to reduce power consumption of the sensor device by using a CMOS-element. Generally, no alignment of a signal shape monitor is necessary, and no displacement of the operating points due to a temperature drift occurs, so that a continuous ground connection can be definitely ascertain independently therefrom. Both the idle current loop monitor and the signal monitor can be incorporated in the plug adaptor when the sensor device is not any more accessible. It is particularly the case, when the plug adaptor has a cast sheathing and cannot be open. In any case, manipulation of the sensor device is successfully prevented. This applies also to the alarm device when it is formed as an alarm card insertable into a computer and has an adjustable duration. Then, the alarm device with a closed computer housing is also unaccessible. The data flow between the computer and separate peripherals and between separate peripherals is not affected by the alarm card because the alarm card cooperates with the power supply and ground contacts and not with data or control contacts when inserted into the computer. If no free slot is available, the alarm device can be arranged in an external housing. In this case, the alarm device can be monitored from a location remote from the computer and connected therewith peripherals and be connected with the sensor device, e.g., by a telephone line. A connection of an alarm device, which is integrated into an already available alarm unit, with a sensor device without a cable is also possible. In all cases, a TV monitoring of a computer with connected peripherals is possible when sensor and alarm devices are connected by a telephone line or without a cable.

For actuation or deactuation of the alarm device, an operational device is provided. In the simplest case, it is preferably formed as a key-operated switch, with a LED, if necessary, for displaying the switch position. Such an operational device or element can be used for monitoring a computer with connected peripherals. If a plurality of computers with connected peripherals, i.e., an entire bureau complex should be monitored, an operational device, which is formed as a programmable operational unit for actuating or deactuating one or more alarm device, is provided. Thereby, targeted separate or a plurality of alarm devices can be addressed, i.e., actuated and deactuated. It is also possible to divide a plurality of computers which, e.g., are connected with each other, in separate groups, with a particular operational unit being associated with each separate group. Generally, with an actuated alarm device, when a ground connection is interrupted between a computer and a connected peripheral, both an acoustic and an optical alarm signal can be generated which, e.g., can then be manually turned off.

In addition to monitoring a connection between a computer and a connected peripheral, the computer itself can be monitored against opening of the housing, provided the computer has a two-part metal housing with a ground line between the two housing parts. This takes place when the ground line has an additional sensor device between the two housing parts for monitoring a ground connection therebetween, with the alarm device being actuated by the additional sensor device for signaling an interrupted ground connection. Naturally, to this end, also spring contacts or the like, which are released when the housing is opened, can be used. In case, the computer includes an interchangeable hard disc, this hard disc can also be monitored against an unauthorized withdrawal, by monitoring the available ground connection between the computer and the hard disc. This is effected by providing in the ground line a looped-in sensor device between the computer and the hard disc for monitoring a continuous ground connection between the computer and the hard disc. In this case, the alarm device is also actuated and by this sensor device for signaling an interrupted ground connection. All in all, the last mentioned measures permit to monitor the computer against the opening of its housing and against withdrawal of the hard disc independently of whether the computer is connected or not with peripherals such as monitor, printer and the like. It should be understood that other components, such as streamer, CD-ROM disc drive or the like can be secured, similar to the hard disc, with an inventive monitoring device.

Figure 2:
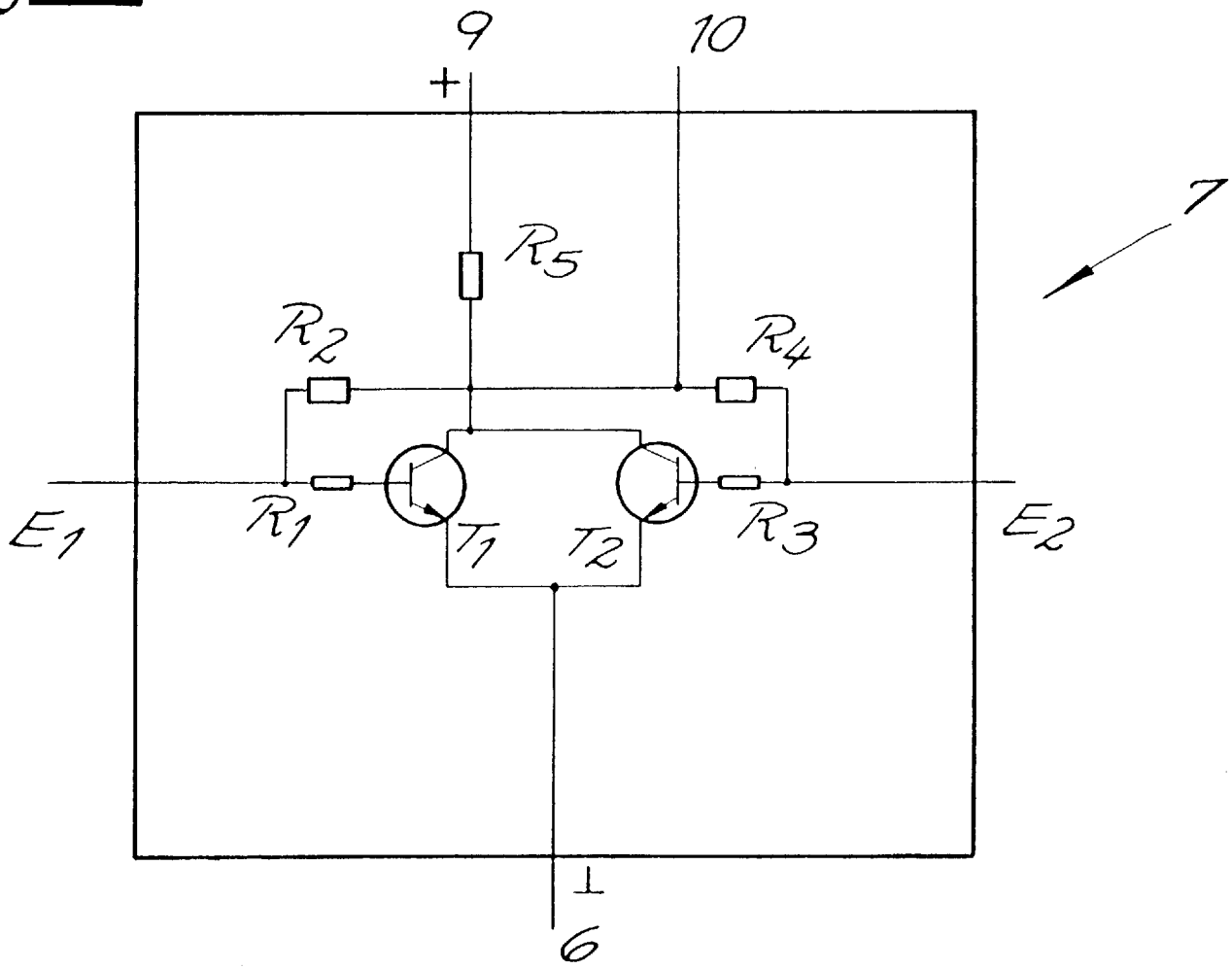

Below, the invention will be explained in detail with reference to the drawing showing an exemplary embodiment of the invention. The drawings show:

FIG. 1 a monitoring device for a computer with a changeable hard disc and with connected monitor and printer;

FIG. 2 a sensor device formed as an idle current loop monitor; and

Figure 3:
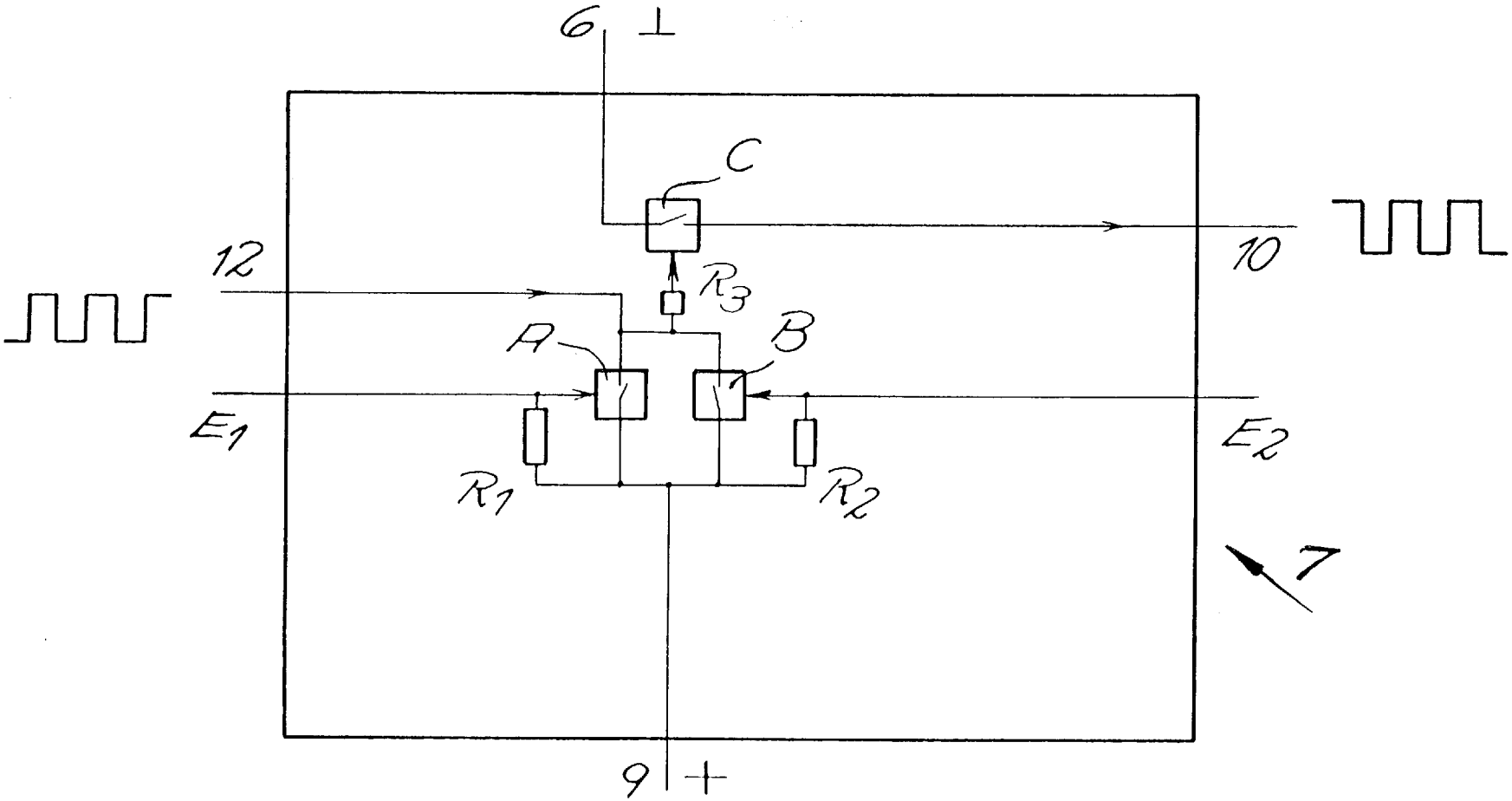

FIG. 3 a sensor device formed as a signal shape monitor

The drawings show a monitoring device for a computer 1 having a changeable hard disc 2 and connected with a monitor 3 and a printer 4. The peripherals 3 and 4, like the changeable hard disc 2, are connected with the computer 1 by a respective ground line 5. Additionally, there is provided a respective ground connection 6 serving as a reference potential. Each ground line 5 has a looped-in sensor device 7 provided between the peripherals 3, 4 and the computer for monitoring a continuous ground connection therebetween. The sensor device 7 is provided for sensing the deviations of the electrical potential at a respective looped-in end of the sensor device 7. There is further provided an alarm device 8, which is actuated by the sensor device 7, for signaling an interruption of the ground connection. In the exemplary embodiment, the sensor device 7 is formed as a plug adaptor pinned on an associated output of the computer 1. The sensor device or the plug adapter 7 has, at a respective looped-in end, a computer-side input $E_1$, and an apparatus-side input $E_2$, and serves for sensing of deviations of one or both of inputs $E_1$ and $E_2$ from the ground potential. Additionally, there are provided an operating voltage connection 9 for feeding currents to the plug adaptor 7, and an output connection 10 with the alarm device 8 for signaling the interruption of the ground connection. The alarm device 8 is formed as an alarm card insertable into the computer 1 and having an adjustable alarm duration. To provide the monitoring device 7 with a network-independent current supply, an accumulator (not shown) is provided on the alarm card. The actuation and deactuation of the alarm card 8 is effected in the exemplary embodiment with an operational element 11 which is formed as a key-operated switch. For actuation and deactuation of one or several alarm devices 8, the operational element 11 can be formed as a programmable operating unit. Such is not shown.

The computer 1 has a two-part metal housing with a ground line 5 between the two housing parts. For monitoring an unauthorized opening of the two-part metal housing, this ground line 5 has an additional looped-in sensor device 7 provided between the two housing parts for monitoring a continuous ground connection between the two housing parts, with the alarm card 8 being also actuated by this additional sensor device for signaling an interrupted ground connection. This, however, is not shown. Additionally or alternatively, a knife switch can be provided on the housing part or the alarm card 8 which would detect the opening of the metal housing and/or the disablement of the entire computer 1. This is, however, also not shown. The same applies to the additional sensor device 7, which is looped-in in the ground line 5 between the hard card 2 and the computer 1, for monitoring a continuous ground connection therebetween. At that, the alarm card is actuated and by this additional sensor device 7 for signalling an interruption of the ground connection.

Functioning of the sensor device 7, which is formed as an idle current loop monitor shown in FIG. 2, will be described below. The sensor device 7 or the idle current loop monitor includes, next to the computer side input E1 and the apparatus side input $E_2$, an additional ground connection 6 which serves as a reference potential, an operational voltage connection 9 for supplying the sensor device 7 with current, and an output connection 10 to the alarm card 8, which is not shown in FIG. 2, for signaling an interrupted ground connection between the input $E_1$, and the computer 1 and/or the input $E_2$ and the monitor 3 or the printer 4. If both inputs $E_1$, and $E_2$ are under the ground potential, i.e, a continuous ground connection between the computer 1 and the monitor 3 or the printer 4 exist, then both semiconductors $T_1$ and $T_2$ are blocked. The output connection 10 is connected with the operational voltage connection 9 by a resistance $R_5$ and has a positive potential, and no alarm is produced by the alarm card 8. When a continuous ground connection is interrupted, i.e., one of the inputs $E_1$, and $E_2$ or both inputs $E_1$, and $E_2$ are not held at the ground potential any more, then either one of the semiconductors $T_1$, and $T_2$ or both semiconductors $T_1$, and $T_2$ are actuated. Then, positive potential is applied to a respective base of the semiconductor $T_1$ and $T_2$ over the resistor $R_5$ and $R_2$ or over resistor $R_4$ and the combination with base protective resistor $R_1$ and $R_3$. The output connection 6 is supplied with the ground potential in a similar manner. The alarm card recognizes the change of the potential from the operational voltage potential to the ground potential and generates a corresponding alarm. A similar effect takes place when the operational voltage connection is interrupted. Then, also in this case, a ground potential is applied to the output connection 10, and the alarm card is actuated.

FIG. 3 shows another type of a sensor device 7 formed as a signal shape monitor of a square wave signal which is fed to an additional input 12 of the sensor device 7 and which is negated at a continuous ground connection. The functioning will be explained below.

The core element of the signal shape monitor are three controlled switches A, B and C which are commercially available as an integrated switching circuit. When both inputs $E_1$, and $E_2$ are under the ground potential, i.e., a continuous ground connection exists between the computer 1 and the monitor 3 and the printer 4, the control inputs of the switches A and B are likewise under the ground potential, and both switches A and B, as shown are open. The square wave signal, which is fed over the additional signal input $\mathbf{12}_1$ controls then, over the resistor $R_3$, the control input of the switch C, which opens and closes, and transmits a negated square wave signal over the output connection 10 to the alarm card 8. In this case, no alarm is produced. As soon as one of the inputs $E_1$ and $E_2$ are not at the ground potential anymore, i.e., a continuous ground connection between the computer, and the monitor 3 or the printer 4 does not exist, the switch A and/or B is closed because its control input receives a positive potential from the operational voltage connection over the resistance $R_1$, $R_2$. As soon as one or both switches A and B are closed, the switch C also becomes closed and does not open or close in accordance with the square wave signal alteration. Consequently, the output connection 10 receives a ground potential, and the alarm card 8 produces an alarm.

The opposite phase position of the square wave signal, which is fed via the input side to the additional signal input 12 opposite to the output side square wave signal, which is transmitted via the output connection 10 to the alarm card 8 at the continuous ground connection, prevents faking of a continuous ground connection by manipulating the output connection 10.

The negated square wave signal can be negated again by further manipulation so that it can be verified whether the input side square wave signal correspond to the (twice negated) output signal.

I claim:

1. A device for monitoring a ground connection between a computer and a peripheral connected by at least one ground line, the monitoring device comprising:

a sensor device to be looped into the at least one ground line for monitoring a continuous ground connection between the computer and peripheral, the sensor device having two looped-in ends associated with the computer and the peripheral, respectively, and serving for sensing deviations of an electrical potential at a respective looped-in end from a ground potential, and the sensor device further having a reference end connected with an additional ground line extending between the computer and the peripheral for providing a reference potential; and an alarm device connected with the sensor device for generating an alarm signal of a broken ground connection in response to the sensor device sensing a deviation of the electrical potential from the reference potential.

2. The monitoring device according to claim 1, wherein the sensor device is formed as an adapter plug attachable to a respective computer output.

3. The monitoring device according to claim 1, wherein the sensor device comprises three inputs defining, respectively, the two looped-in ends and the reference end, and an output connected with the alarm device; and wherein the monitoring device further comprises voltage means for supplying power to the sensor device.

4. The monitoring device according to claim 3, wherein the voltage means comprises a battery.

5. The monitoring device according to claim 1, wherein the sensor device comprises one of a closed circuit loop monitor and a signal form monitor for monitoring a square wave signal supplied to at least one of two inputs defining the two looped-in ends.

6. The monitoring device according to claim 1, wherein the alarm device comprises an alarm insert card adapted to be plugged into the computer and having an adjustable alarm duration.

7. The monitoring device according to claim 1, further comprising a control device for activating and deactivating the alarm device.

8. The monitoring device according to claim 7, wherein the control device comprises a key-operated switch.

* * * * *